US006041636A

United States Patent [19]

Datzuk et al.

[11] Patent Number: 6,041,636

[45] Date of Patent: Mar. 28, 2000

[54] SIDE SUPPORTED 6-HIGH ROLLING MILL

[75] Inventors: Alexander Datzuk, Terryville, Conn.; Yves Guillot, Montbrison, France; Lucas M. Young, Naugatuck, Conn.

[73] Assignee: T. Sendzimir, Inc., Waterbury, Conn.

[21] Appl. No.: 09/027,062

[22] Filed: Feb. 20, 1998

[51] Int. Cl.[7] ..... B21B 31/07; B21B 31/08

[52] U.S. Cl. ..... 72/238

[58] Field of Search ..... 72/238, 239, 237, 72/43, 44, 236, 245

[56] References Cited

U.S. PATENT DOCUMENTS

| | | | |
|---|---|---|---|
| 3,864,955 | 2/1975 | Eibe | 72/245 |
| 4,270,377 | 6/1981 | Verbickas et al. . | |
| 4,531,394 | 7/1985 | Turley et al. . | |
| 5,197,170 | 3/1993 | Sendzimir et al. . | |

*Primary Examiner*—Rodney Butler
*Attorney, Agent, or Firm*—Frost & Jacobs LLP

[57] ABSTRACT

A 6-high cold rolling mill. The mill is of the type having free floating, side-supported upper and lower work rolls, chock mounted upper and lower intermediate rolls and upper and lower back up rolls. Vertically acting hydraulic cylinders are provided for intermediate roll balancing, bending, counter-balancing and vertically shifting the upper and lower intermediate rolls toward and away from each other. Horizontal cylinders provide axial shifting of the intermediate rolls and two cylinder actuated supports are provided to lift the upper work roll. All of these cylinders are mounted on the mill housing and no hydraulic disconnection and reconnection is required for replacement of the intermediate rolls and/or the work rolls. Each intermediate roll assembly supports between its chocks a pair of side support assemblies for the work rolls. Lubrication to the intermediate roll chocks and side support assemblies is made by spring loaded lubrication connections mounted on the front and rear doors of the mill housing. Movement of the upper and lower intermediate roll chocks away from each other automatically disconnects the lubrication connections from the chocks. Movement of the upper and lower intermediate roll chocks toward each other automatically reconnects the lubrication connections to the chocks.

23 Claims, 10 Drawing Sheets

REMOVAL POSITION

WORKING POSITION

REMOVAL

WORKING

SIDE SUPPORTED 6-HIGH ROLLING MILL

TECHNICAL FIELD

The invention relates to a 6-high cold rolling mill, and more particularly to such a mill wherein the upper intermediate roll assembly and the lower intermediate roll assembly can be removed and replaced without the necessity of having to manually disconnect or reconnect any lubricating oil or oil mist lines.

BACKGROUND ART

This invention relates to 6-high cold rolling mills having side supported work rolls of the kind described generally in U.S. Pat. No. 4,270,377 and 4,531,394. The improvements described herein are of particular use when the rolling mill is part of a continuous line as described generally in U.S. Pat. No. 5,197,179.

The intermediate and work roll area of a 6-high mill according to the prior art is shown in FIG. 1 and FIG. 2. Salient features of the design are:

1. An adjustment mechanism 11 provides axial shifting of each intermediate roll 13 by means of hydraulic cylinders and a thrust bearing assembly (not shown). The mechanism is mounted on the operator side intermediate roll chocks 12. This mechanism requires two hydraulic connections 18, and an electrical connection 19 for a transducer measuring the axial position of the roll.
2. Lubricating oil or oil mist connections 14 to the intermediate roll chocks are present to provide lubrication to the intermediate roll neck bearings.
3. Side support cluster arm assemblies 15 are each pivotally mounted on a pivot rod (not shown), which spans between the operator side and the drive side intermediate roll chocks 12 and 16 respectively. The terms "operator side" and "drive side" are well known terms of art and refer to the front side of the mill at which the operator is located and to the rear side from which the mill is driven, respectively. These cluster arm assemblies each include a side support roll (not shown) and two sets of side support bearings (not shown), and thus require a lubricating oil or oil mist supply, which is usually achieved using a connection to the pivot rod 17, which is hollow and so can provide a path to the side support bearings through which the lubricating oil can be delivered through hoses 20.
4. Hydraulic cylinders 21, which are mounted between upper and lower intermediate roll chocks 12 and 16, are used to supply balance, bending and counterbending forces to the intermediate rolls. These hydraulic cylinders require hydraulic oil connections to their ports 22, usually four on the drive side and four on the operator side.
5. Two upper work roll lift assemblies (one of which is shown at 23 in FIG. 2), each consist of a hydraulic cylinder (not shown) connected to a pivoting support arm used to support the upper work roll when the mill screwdown is opened, to create a gap between upper and lower work rolls for threading the mill. These assemblies are mounted on the upper intermediate roll chocks at the drive and operator sides, and require two hydraulic connections 24 to each of these upper chocks.
6. Keeper plates (one of which is shown at 25 in FIG. 1) which can be hydraulically or manually actuated and are mounted on the Mae West blocks (shown at 27) attached at the operator side of mill housing 28. These keeper plates engage with slots 26 in the operator side intermediate roll chocks 12 (or in the housing of the lateral adjustment mechanism 11 which is mounted on these chocks) in order to locate each intermediate roll assembly in its correct axial position in the mill and to support any axial thrust which might develop on the roll assemblies during rolling.

These features all provide important functions, and for many applications the features described do a very good job and represent a very cost effective approach. However, singly, or as a group, they suffer from disadvantages under some conditions.

1. Apart from feature No. 6 above, they all require hydraulic or lubricating oil connections to the intermediate roll assemblies. Whenever the intermediate rolls are changed, it's necessary to disconnect the pipes, hoses or cables from the assemblies to be removed, and to reconnect the same pipes, hoses or cables to the new intermediate roll assemblies. This takes a fair amount of time, of the order of 15–30 minutes. For cases where intermediate roll changes are infrequent (say fewer than one change per week) the amount of lost time is negligible, but if changes are frequent the amount of lost time is considerable.
2. Mounting the axial adjustment mechanism on the operator side intermediate roll chocks (feature 1) means that for every such chock an adjustment mechanism must be supplied. For mills having only two (or perhaps three) sets of chocks this is not a significant disadvantage, because the ability to do maintenance on these mechanisms when the intermediate roll assemblies are out of the mill means that reliable operation can be maintained without additional spares. However, for very high production mills where several intermediate roll assemblies are required, this becomes very expensive, and it would then be an advantage to be able to mount the axial adjustment mechanisms in a fixed position, so that they could be disengaged from the intermediate roll chocks at roll change time.
3. A similar situation applies for the case of the intermediate roll balance/bending/counterbending cylinders (feature 4) and for the case of the upper work roll lift assemblies (feature 5). It would be advantageous to remove these items from the intermediate roll assemblies and mount them in fixed positions in the mill so that they can be disengaged from the intermediate roll chocks at roll change time.
4. In the case of a mill according to U.S. Pat. No. 5,197,179, where it may be necessary to change intermediate rolls with strip in the mill or passing through the mill, the chock mounted balance/bending/counterbending cylinders of feature 4 cannot be used anyway, because the presence of strip in the mill would prevent removal or insertion of the intermediate roll assemblies if such cylinders were installed.

It is the object of this invention to provide an arrangement whereby no hydraulic cylinders are mounted on the intermediate roll chock assemblies, and to provide improved methods of connecting and disconnecting the lubricating oil supply to these chocks during roll change, that will not require manual intervention.

The invention provides the following features which enable the problems of the prior art rolling mills to be overcome.

1. Intermediate roll balance/bending, and counterbalance hydraulic cylinders are incorporated in the "Mae West"

blocks and so remain in the mill at roll change time. There is no need to make any hydraulic connections/disconnections at this time.

2. These cylinders are provided with a long stroke, enabling a large separation of upper and lower intermediate and work rolls when work and/or intermediate rolls are changed. This solves four problems and also enables large clearances between work rolls and strip at roll change time, avoiding possibility of marking of rolls or strip if the rolls touch the strip during roll change. The four problems solved are:

a. It is not necessary to use moveable keeper plates, since the large vertical movement of upper and lower intermediate roll chocks causes them to disengage from the keeper plates, which can now be fixed.

b. In a similar manner, intermediate roll axial shift fingers, attached to cylinders which are mounted on both sides of each intermediate roll drive spindle, (if intermediate rolls are driven), each engage with a thrust housing associated with one of the intermediate rolls to be changed. It's not necessary to use any other disconnection mechanism—the large vertical movement of the intermediate rolls is enough to disconnect the axial shift fingers from their respective thrust housing. Hydraulic connections to shift cylinders do not have to be touched.

c. The resulting large gap between work rolls enables the upper work roll support cylinders to be mounted in fixed position on the Mae West blocks, rather than on the upper intermediate roll chocks. These cylinders can thus be permanently piped and there is no need to connect/disconnect them at roll change time.

d. Spring loaded lubricating oil (or oil mist) connections are mounted on the work roll thrust doors, these connections including spring loaded hollow plungers that operate in the vertical direction, and bear against the inner faces of the intermediate roll chocks. The large vertical separation of the intermediate roll chocks at roll change time causes the intermediate roll chocks to come out of contact with these plungers, enabling the rolls to be removed. It is not necessary to provide any other device to connect and disconnect lubricating oil supply to the chocks and cluster arms at roll change time. The vertical movement of the chocks is sufficient.

The fundamental problem of mounting intermediate roll axial shift cylinders at the sides of the drive spindles is that these cylinders occupy the space needed by the spindle clamps—the spindle clamps being essential to support the drive spindles during intermediate roll change. The invention includes means to overcome this problem.

DISCLOSURE OF THE INVENTION

According to the invention there is provided a 6-high cold rolling mill. The mill is of the type having free floating side supported upper and lower work rolls, chock mounted upper and lower intermediate rolls, and upper and lower back up rolls. The work rolls are axially located by thrust bearings mounted on the front and back doors of the mill. Vertically acting hydraulic cylinders are provided for intermediate roll balancing, bending, counterbalancing, and vertically shifting the upper and lower intermediate rolls toward and away from each other. Horizontal cylinders provide axial shifting adjustment of the intermediate rolls, two cylinder actuated support assemblies are provided to lift the upper work roll to provide a gap between work rolls. All of the hydraulic cylinders above described are mounted on the mill housing assembly and no disconnection and reconnection are required for replacement of the intermediate rolls, or the work rolls, or both. Each intermediate roll assembly supports between its chocks a pair of side support cluster arms. Lubrication to the intermediate roll chocks and cluster arms is provided via spring loaded lubricating oil or oil mist connections mounted on the front and back doors of the mill housing. Upward vertical movement of the upper intermediate rolls and downward vertical movement of the lower intermediate rolls automatically disconnect the chocks from spring loaded connections. Movement of the upper and lower intermediate rolls toward each other automatically reconnects the spring loaded connections to the chocks.

DETAILED DESCRIPTION OF THE INVENTION

Figure 1:
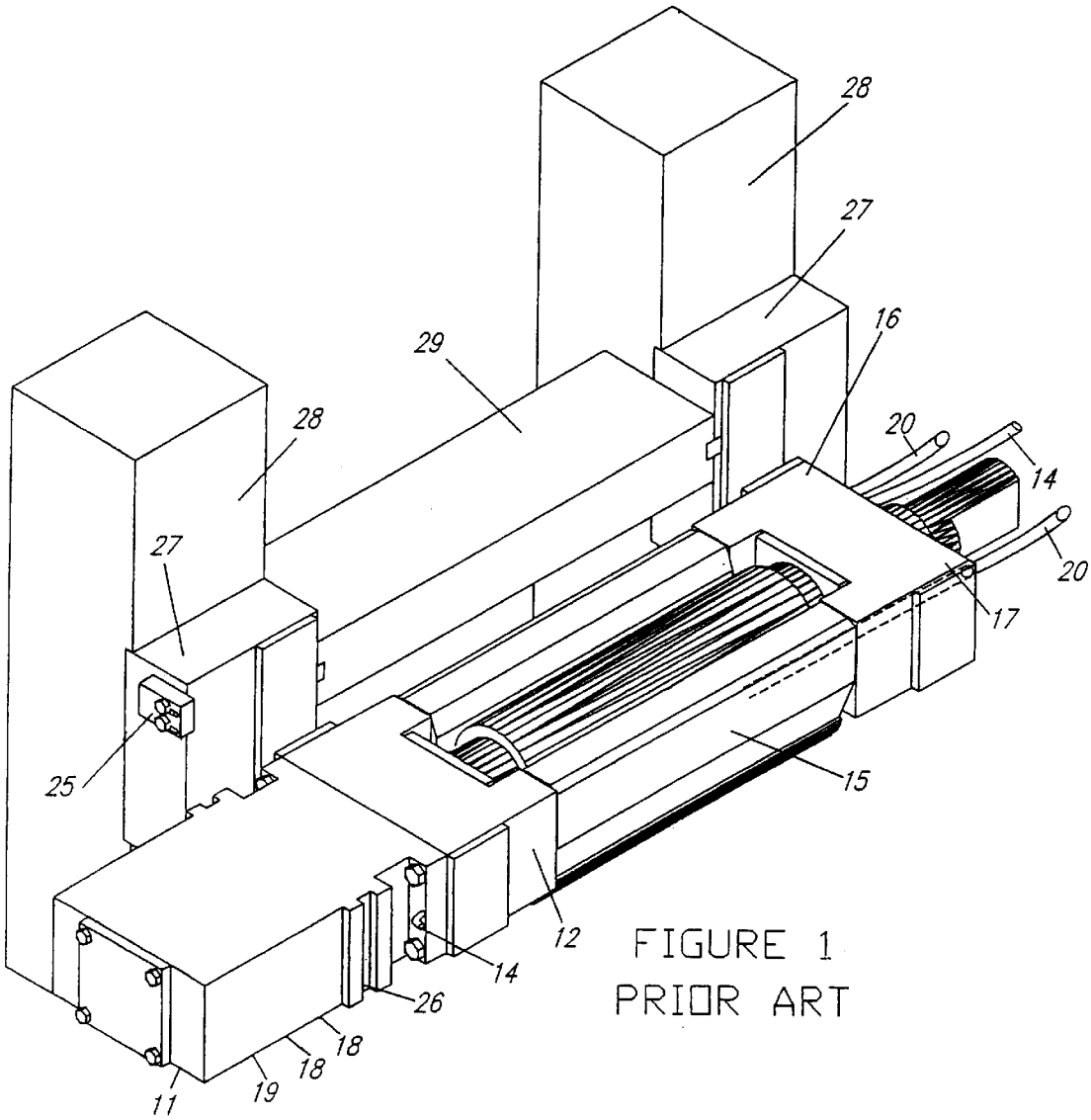
FIGURE 1 PRIOR ART
FIG. 1 is an isometric semi-exploded partial view of the side supported 6-high mill according to the prior art.
Figure 2:
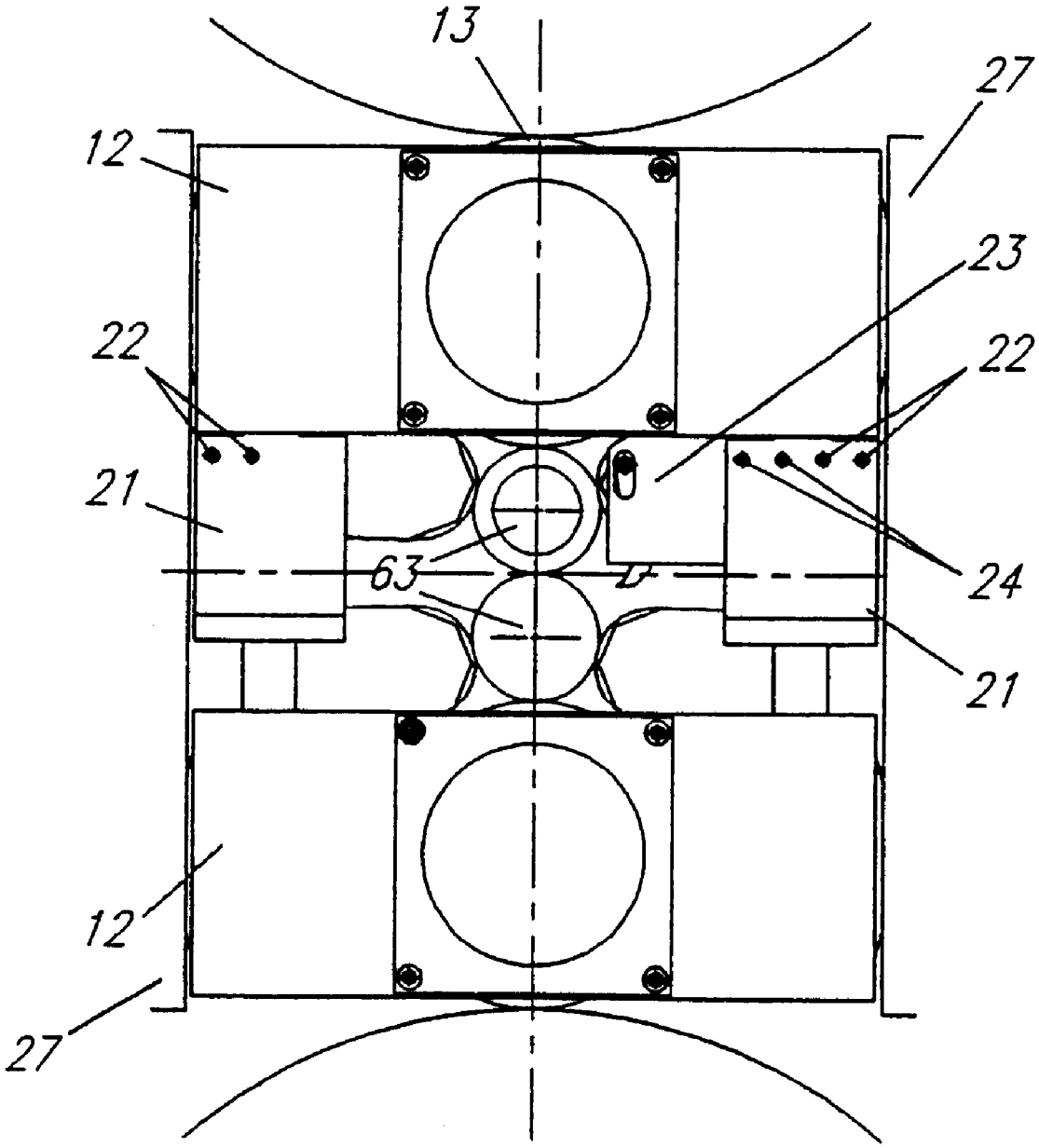
FIGURE 2 PRIOR ART
FIG. 2 is a partial front elevation of the rolls and chocks of a side supported 6-high mill according to the prior art.

The salient features of the prior art side supported 6-high rolling mill are shown in FIGS. 1 and 2 and described in the introduction. The intermediate roll assembly shown in FIG. 1 is mounted in the window of rolling mill housings 28, within the gap formed by "Mae West" blocks 27, and side support beams 29 which span between operator side and drive side "Mae West" blocks. The prior art mill also includes work rolls which float freely in the mill ( these are shown at 63 in FIG. 2) and which are axially located by means of work roll thrust bearings mounted in pivoting doors (not shown) at the front (operator side) and back (drive side) of the mill.

Figure 3:
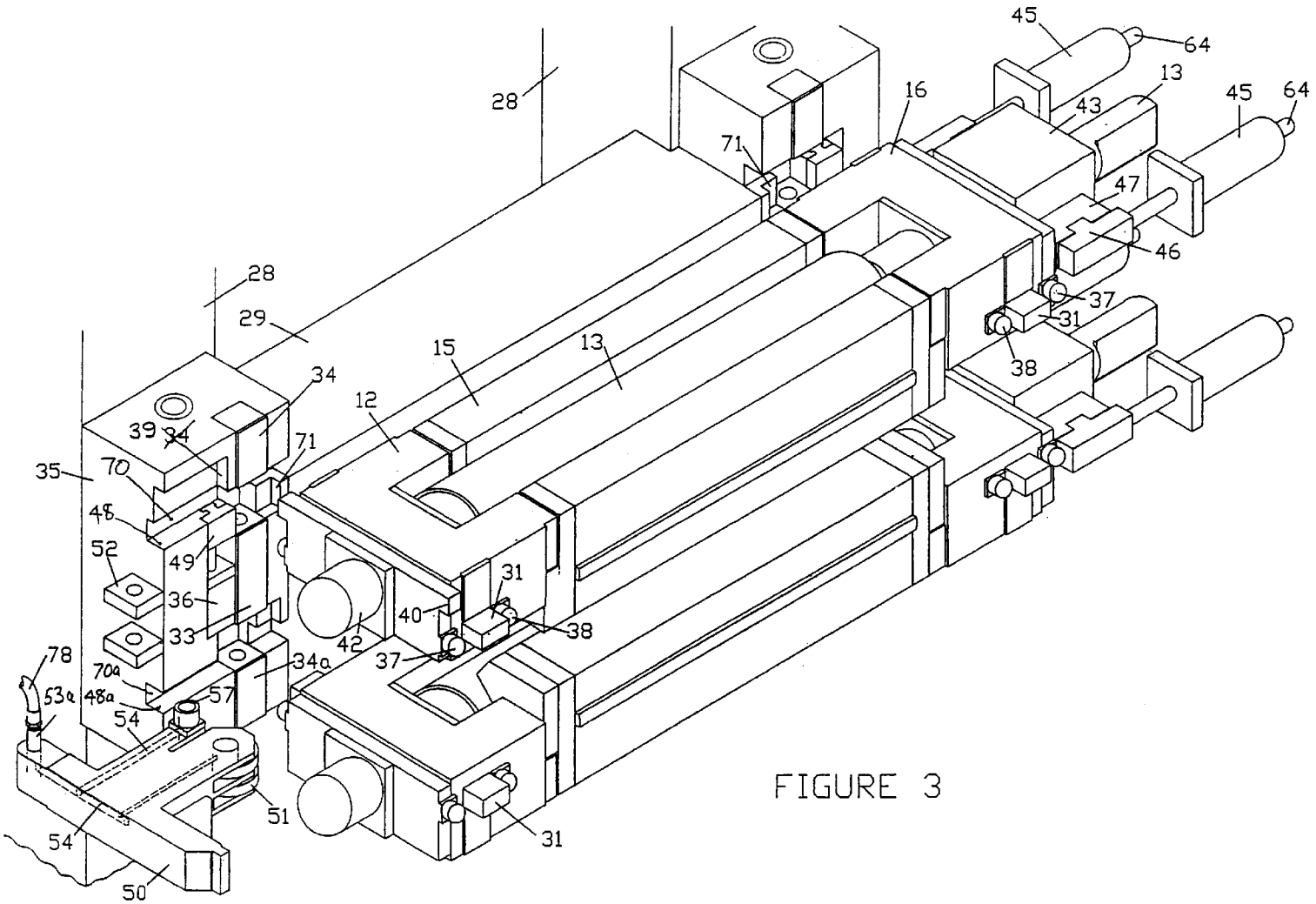
FIG. 3 is an isometric semi-exploded partial view of a side supported 6-high mill according to the present invention.

A mill according to one embodiment of the present invention is shown in FIG. 3. In FIG. 3 like numerals refer to like parts of the prior art mill of FIG. 1. In FIG. 3 the work rolls and back door are omitted for the sake of clarity. FIG. 3 can be compared with FIG. 1 in order to obtain a clear picture of the novel features. The following description applies to the upper intermediate roll assembly. It is to be understood that the arrangement is essentially symmetrical about a fixed horizontal pass line, so the lower assembly is the same as the upper, but inverted. Like parts of the lower intermediate roll assembly have been given like index numerals, followed by "a".

The intermediate roll 13 is mounted in chocks 12 and 16, and cluster arms 15 are mounted on pivot rods 17 (see FIG. 6) spanning between chocks 12 and 16 as in prior art FIG. 1. Hereinafter, the assemblies consisting of these parts will be referred to as "the upper intermediate roll assembly" and "the lower intermediate roll assembly". Mae West blocks 35 replace prior art Mae West blocks 27, and are mounted in the windows of housings 28. Side support beams 29 (one of which is shown in FIG. 3) span between front and rear Mae West blocks 35.

The mechanism 11 used for axial shifting of intermediate rolls shown in FIG. 1 is removed, and a cover 42 is used in its place to cover the exposed end of intermediate roll 13. Axial shifting is achieved by a pair of fixed hydraulic cylinders 45, mounted at the back (drive side) of the mill on each side of drive spindle 44 (see FIG. 6). These cylinders 45 are used to move shift fingers 46, which engage with matching recesses in ears 47 of thrust housing 43. Thrust housing 43 is mounted on bearings on roll 13 (see FIG. 6). This structure will be described hereinafter.

Figure 4:
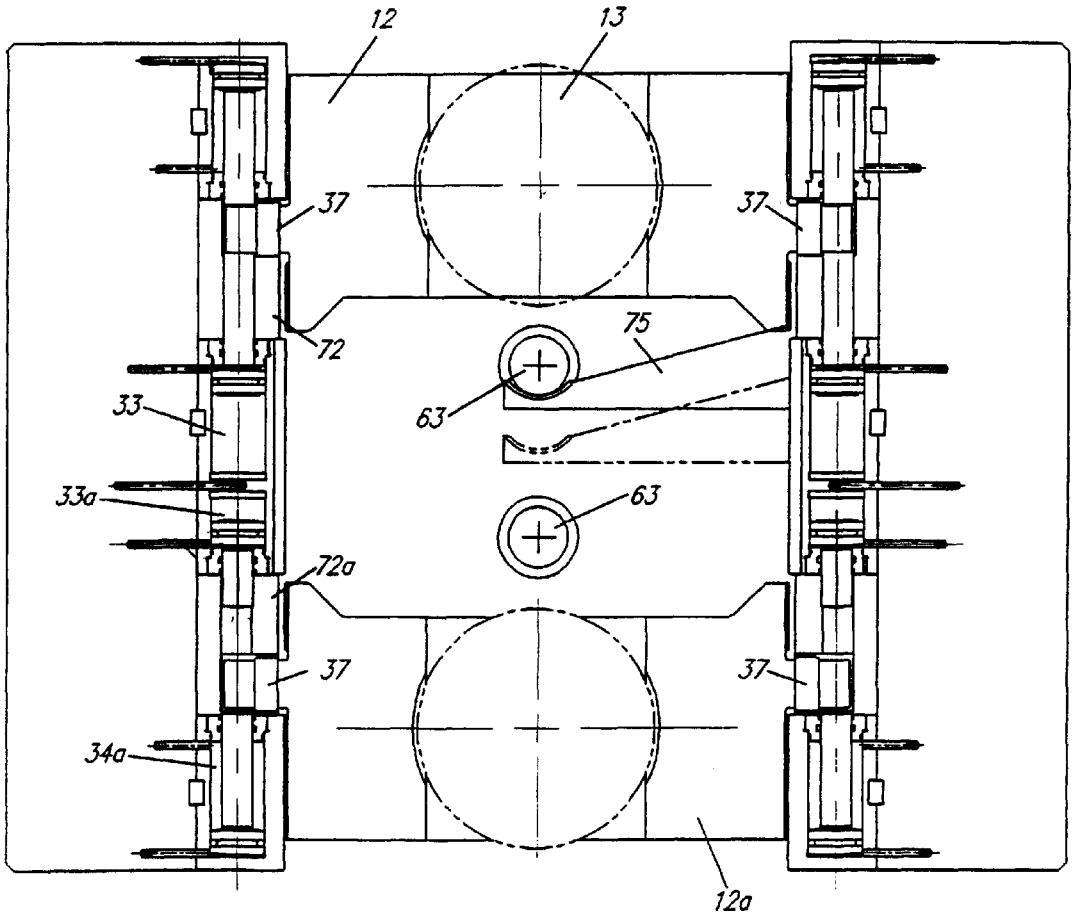
FIG. 4 is a simplified partial front elevation of an upper intermediate roll chock in the removal position.
Figure 5:
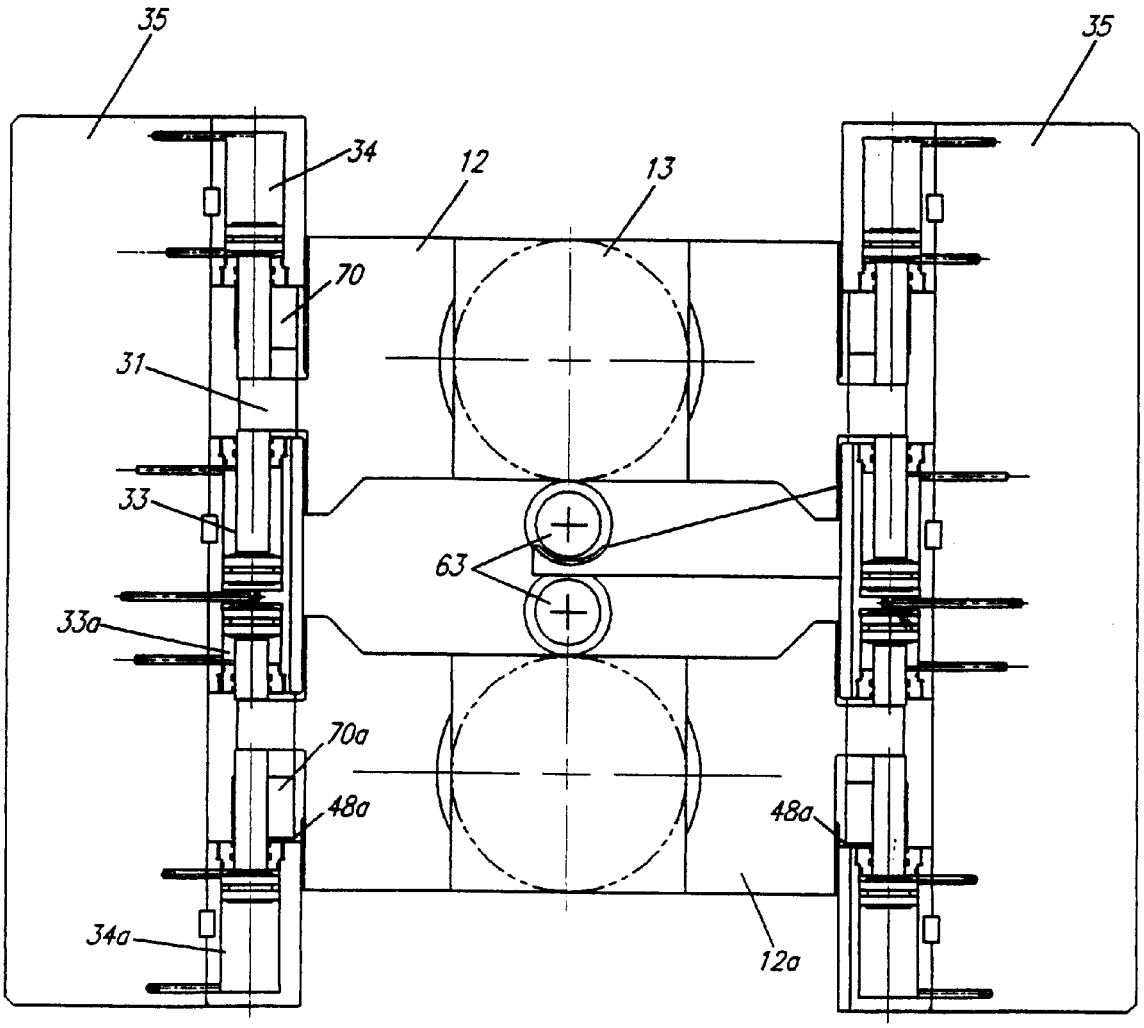
FIG. 5 is a simplified partial front elevation of an upper intermediate roll chock in the working position.
Figure 6:
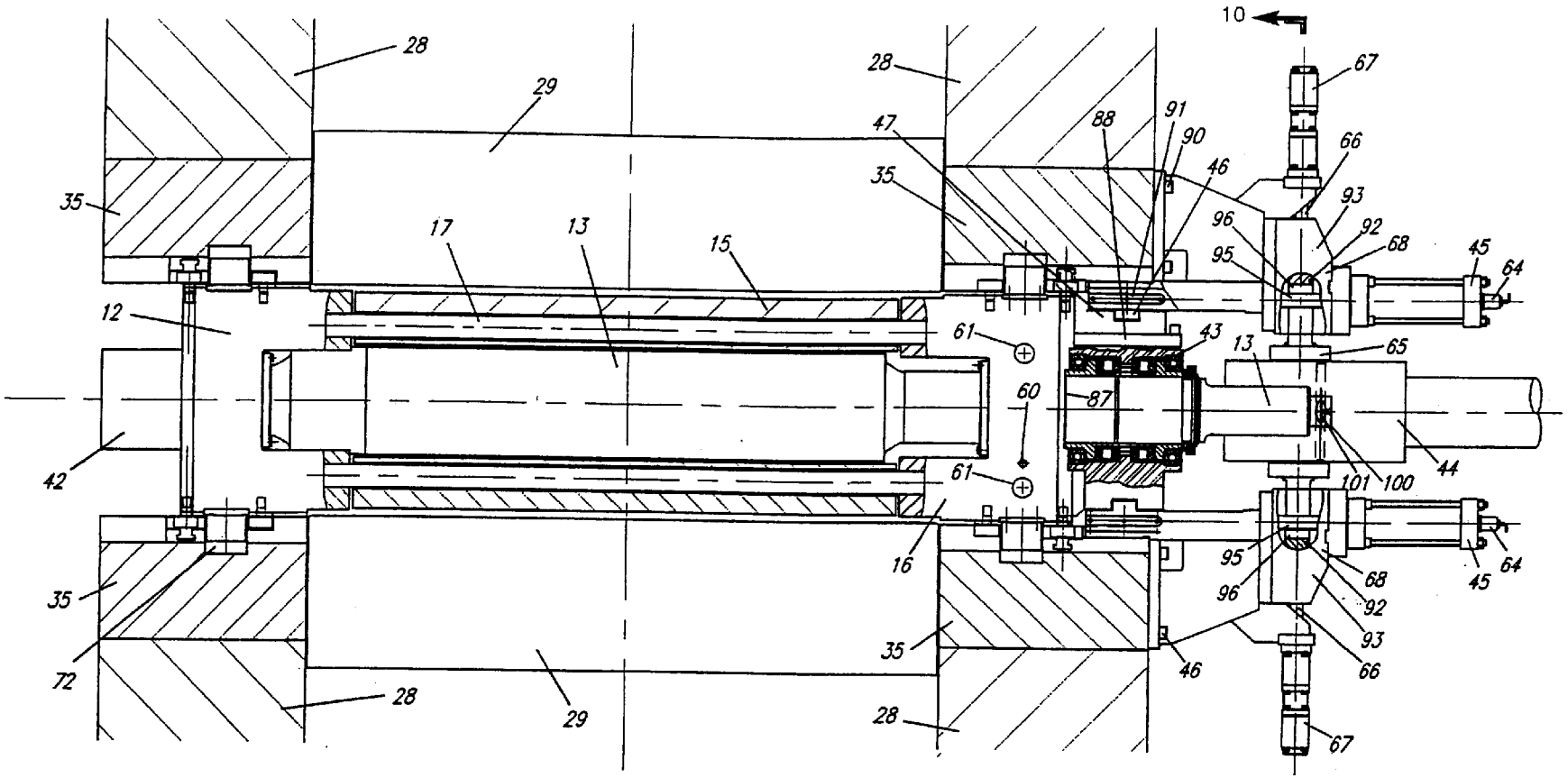
FIG. 6 is a fragmentary plan view, partly in cross-section, illustrating an upper intermediate roll assembly mounted in the mill.

To provide for intermediate roll balance and roll bending, hydraulic cylinders 33, shown in FIG. 3, are located in Mae West blocks 35. Corresponding hydraulic cylinders 34 are used for counterbending and are also mounted in the Mae West blocks. Bending ears 31 are provided on each side of chocks 12 and 16. These project into slots 70 in the Mae West blocks as shown in FIGS. 4, 5 and 6, and pass through these slots at roll change time when the entire intermediate roll assembly is inserted into and removed from the mill. After the intermediate rolls are changed, cylinders 33 are retracted, enabling the ears 31 to drop into pockets 72 formed in the Mae West block so that the chocks 12 are axially located in the Mae West blocks so no separate keeper plates are required. Ears 40 on front chock cover 42 engage with stop 39 when the roll/chock assembly is first inserted in the mill, to ensure that ears 31 are properly aligned with pockets 72 before the assembly is lowered to the working position shown in FIG. 5.

Wheels 37 and 38 are provided at each side of chocks 12 and 16. Four wheels are used on each chock to bridge the discontinuities in the lower surface 48 of slot 70 in the Mae West blocks, upon which the wheels roll at roll change time. Pockets 71 provide space for wheels 38 to drop into when the assembly is lowered to the working position. Wheel lift cylinders 36, mounted in Mae West blocks 35, can raise and lower wheel lift blocks 49, which support wheels 37 to raise the assembly to removal height at the start of roll change cycle. In the extended position of cylinders 36, the top of lift blocks 49 is flush with surface 48. In the retracted position of cylinders 36, block 49 drops down to provide a pocket similar in size to pocket 71, and provides a space for wheels 37 during mill operation. It should be noted here that, although the Mae West structure is essentially symmetrical about the horizontal pass line, it's not necessary to use cylinders 36 at the bottom, because gravity will bring the lower assembly from working position to the removal position when lower counterbending cylinders 34*a* are retracted.

The front elevation of FIG. 4 shows the upper and lower assemblies at the removal levels, i.e. just after inserting the assemblies into the mill or just before removing them. When at this level, the assemblies are separated by around 200 mm relative to their working levels, the upper assembly being raised by substantially half this amount (by extending the upper roll balance cylinders 33), and the lower assembly being lowered by substantially half this amount, (by fully retracting the lower roll counterbending cylinders 34*a*). It should be noted that upper and lower screwdowns (not shown) should each be opened by about 110 mm at this time, and the wheel lift cylinders 36 should also be extended to provide support for the upper assembly by means of wheels 37. If the cylinders 33 are now retracted, the upper and lower assemblies will be at the removal levels, the upper assembly's wheels 37 resting on support blocks 49, and the lower assembly's wheels 37 and 38 resting on surfaces 48*a* at the bottom of the lower slots 70*a* in the Mae West blocks. After opening the front door 50, by releasing the door latch (not shown) and swinging the door open (the door is hinged on pin 53 mounted in pivot block 52), it is possible to roll the upper and lower assemblies in or out of the mill at this level (of course roll change actuator and external rails, not shown, are required to do this). It should also be noted that, when the assemblies are separated to the removal levels shown in FIG. 4, chock bending ears 31 disengage from recesses 72 in Mae West blocks, so chocks 12 and 12*a* are no longer axially located, and also lugs 47 and 47*a* on thrust housings 43 and 43*a* (mounted on intermediate rolls 13) disengage from shift fingers 46 and 46*a* so intermediate rolls 13 and 13*a* are no longer axially located, thus freeing the assemblies from axial location, and enabling them to be rolled out of the mill.

At roll change time the upper work roll 63 is supported by arms (one of which is shown at 75 in FIG. 4. Arms 75 (at front and back) are raised and lowered by hydraulic cylinders (not shown) mounted in two of the 4 Mae West blocks 35. During rolling, arms 75 are lowered to the position shown in FIG. 5, where they clear the work rolls.

The front elevation of FIG. 5 shows the upper and lower assemblies at their working levels. It can be seen that the upper chock bending ears 31 have dropped below the upper slot 70 in Mae West block 35, and the lower chock bending ears 31*a* have lifted above the lower slot 70*a*. Upper chock bending ears 31 are trapped in pocket 72, and lower chock bending ears are trapped in pocket 72*a*. It can be seen that at the working levels, counterbending cylinders 34 and 34*a* operate close to their extended positions, and roll balance/bending cylinders 33 and 33*a* operate close to their retracted position.

The upper axial shifting cylinders 45 and shift fingers 46 (FIG. 3 and FIG. 7) are located at the mean working level of the upper assembly, and the lower ones (45*a* and 46*a*) are located at the mean working level of the lower assembly. Thus, when the assemblies (including thrust housings 43, 43*a* and their lugs 47, 47*a*) are at the working level, shift fingers 46, 46*a* are engaged with lugs 47 and 47*a* respectively, and shift cylinders can be used (usually under servo control using position feedback provided by transducers 64, 64*a* mounted on cylinders 45, 45*a*).

There are two more factors that have to be considered before the assemblies can be safely removed from the mill. Firstly the lubrication connections to the chocks must be removed and secondly, the drive spindles 44 and 44*a* must be disconnected. The invention includes means for performing these tasks without the need for operator intervention.

Figure 7:
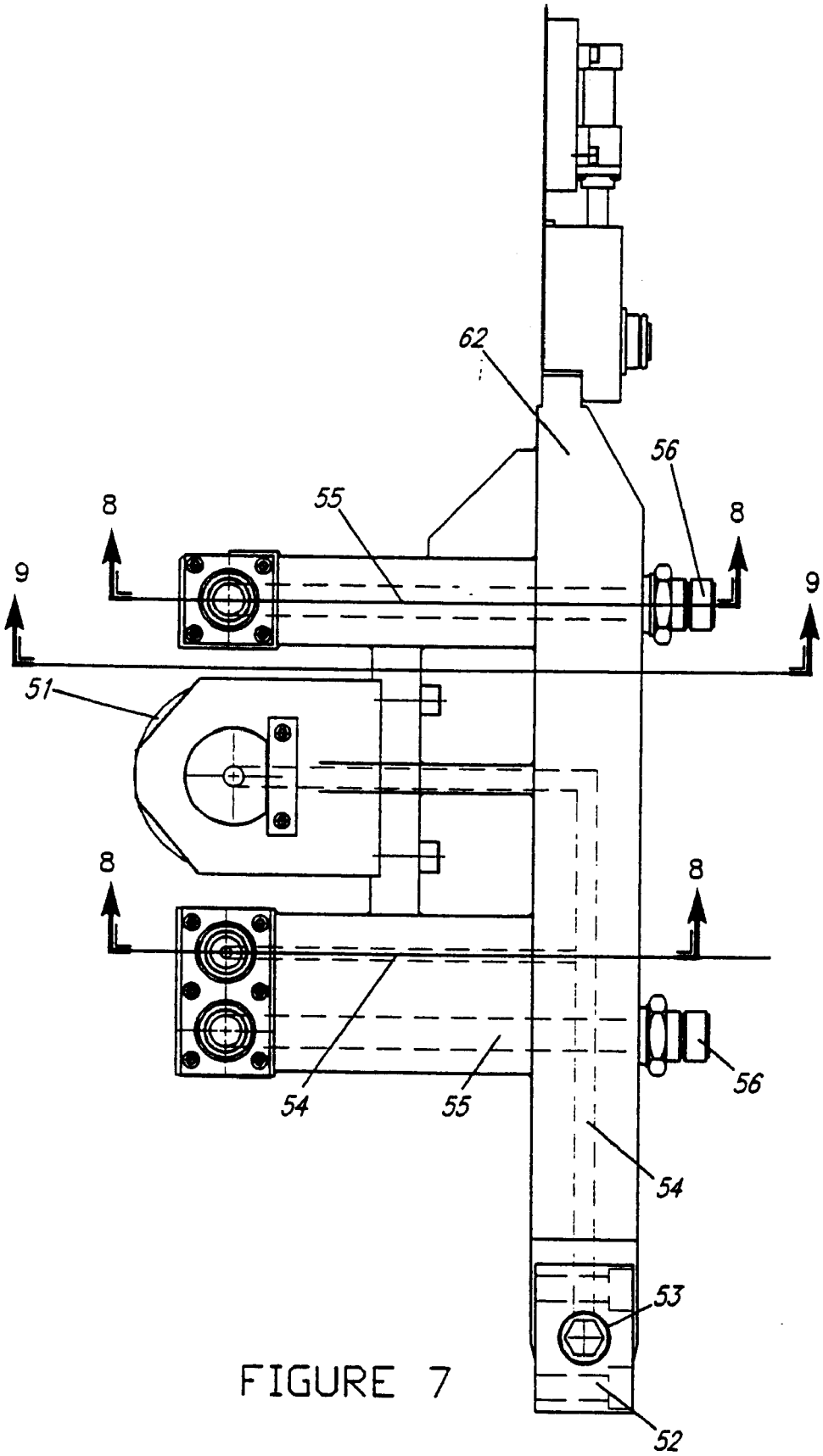
FIG. 7 is a plan view of the rear work roll thrust door with lubrication connections.
Figure 8:
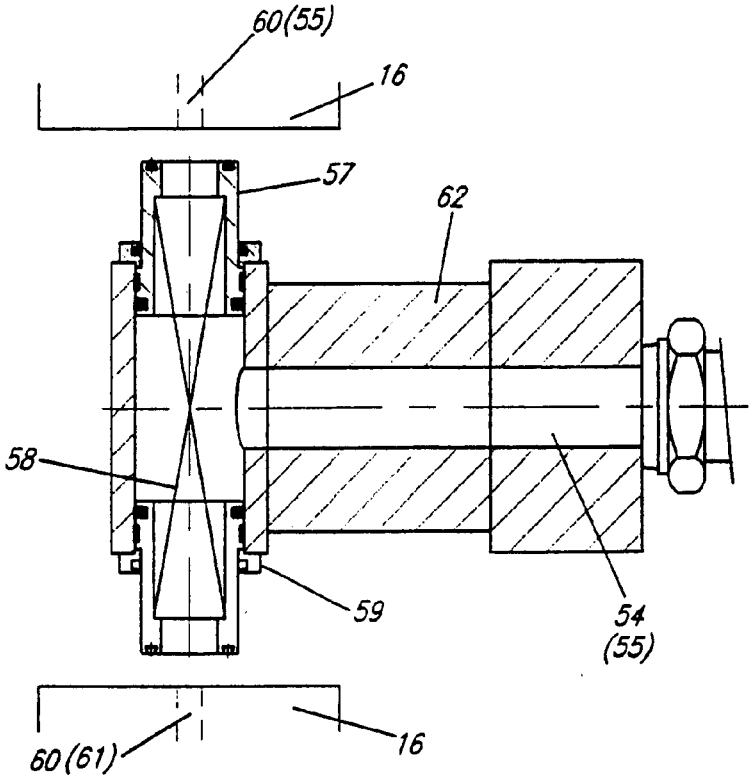
FIG. 8 is a fragmentary cross-sectional view taken along either section line 8—8 of FIG. 7.
Figure 9:
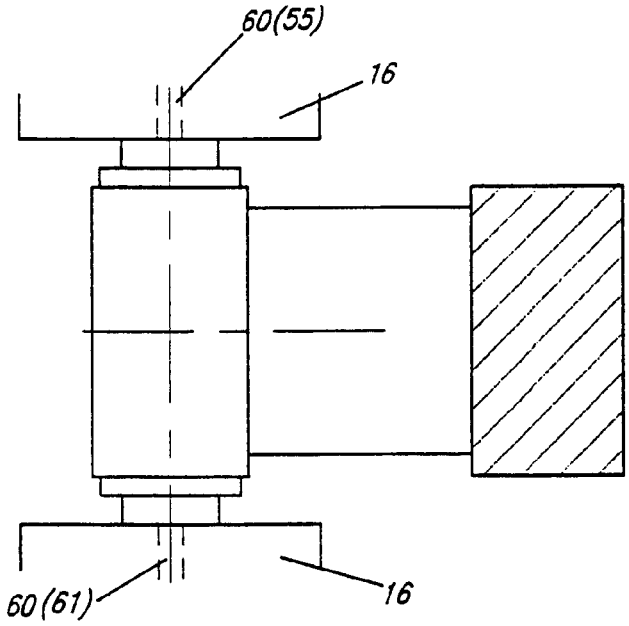
FIG. 9 is a fragmentary cross-sectional view taken along section line 9—9 of FIG. 7.

The front door 50 is shown in FIG. 3 and the back door 62 is shown in FIG. 7. Details of the hydraulic connection to the chocks are shown in FIGS. 8 and 9.

Both front door 50 and back door 62 are mounted on hollow hinge pins 53 and 53', respectively, which fit in hinge blocks (two of which are shown at 52 in FIG. 3), mounted on Mae West blocks 35. Lubricant, usually oil or oil mist, is supplied through hoses (one of which is shown at 78 in FIG. 3) to hinge pins 53 and 53' and flows through connecting oil passages 54*a* and 54*a'* and 54*b* and 54*b'* to chambers 79 and 79' within doors 50 and 62. Within the chambers 79 and 79' are upper and lower hollow plungers 57, which are loaded by spring 58 against upper and lower chocks 12, 12*a*, 16, and 16*a* when the chocks are at the working level as shown in FIG. 9. The plungers form a tight seal against the chocks by means of seal rings 57*x*. The lubricant thus flows through hollow plungers 57 and into the connecting oil passage 60 which connects to the roll neck bearing within the chock. When the assemblies are opened to the removal level, the plungers are urged apart by spring 58 until they are prevented from further movement by retainers 59, which thus sets a vertical gap between each plunger 57 and each adjacent chock 16, 16*a* (or 12, 12*a*) which enables the assemblies to be removed, or the door opened, without any sliding contact between plungers and chocks.

It should be noted that oil passage 54*a* and 54*a'* in doors 50 and 62 are branched so that lubricant is supplied to work roll thrust bearings 51 and 51' via passages 54*c* and 54*c'* as well as to roll neck bearings in chocks 12, 12*a*, 16 and 16*a* via passages 54*b* and 54*b'*.

The bearings mounted within cluster arms 15 are lubricated by lubricant passing through hollow pivot shafts 17 (see FIG. 6) as in the prior art mill. However, instead of supplying oil directly by hose connections to the pivot shafts (as is done in prior art mills, and which requires connections to be broken and made at roll change time) the oil holes in pivot shafts 17 connect to oil holes 61 in rear intermediate roll chocks 16 and 16*a*. Passages 55 (see FIG. 7) in back door 62 connect to oil holes 61 (see FIG. 6) in exactly the same way described above for the connection of oil passage 54*b'* (see FIG. 7) in back door 62 to holes 60 (see FIG. 6) in rear chocks 16. It will be understood that FIG. 6 illustrates upper intermediate roll 13. Thus holes 60 and 61 are on the underside of upper rear chock 16. Note that there are two holes 61 in each rear chock 16, each hole supplying oil to one cluster arm 15. Hose connections 56 are used to bring lubricant to passages 55 in back door 62. Usually it's not necessary to open the back door at tool change time so these connections can remain undisturbed.

The front door 50 must be opened at roll change time, and this is why the oil supply to the roll neck bearings in front chocks 12 and 12*a* and front work roll thrust bearing 51 is brought in through door pivot shaft 53 as shown in FIG. 3. In this way it's not necessary to disturb hose connection 73 (FIG. 3) at roll change time.

Figure 6A:
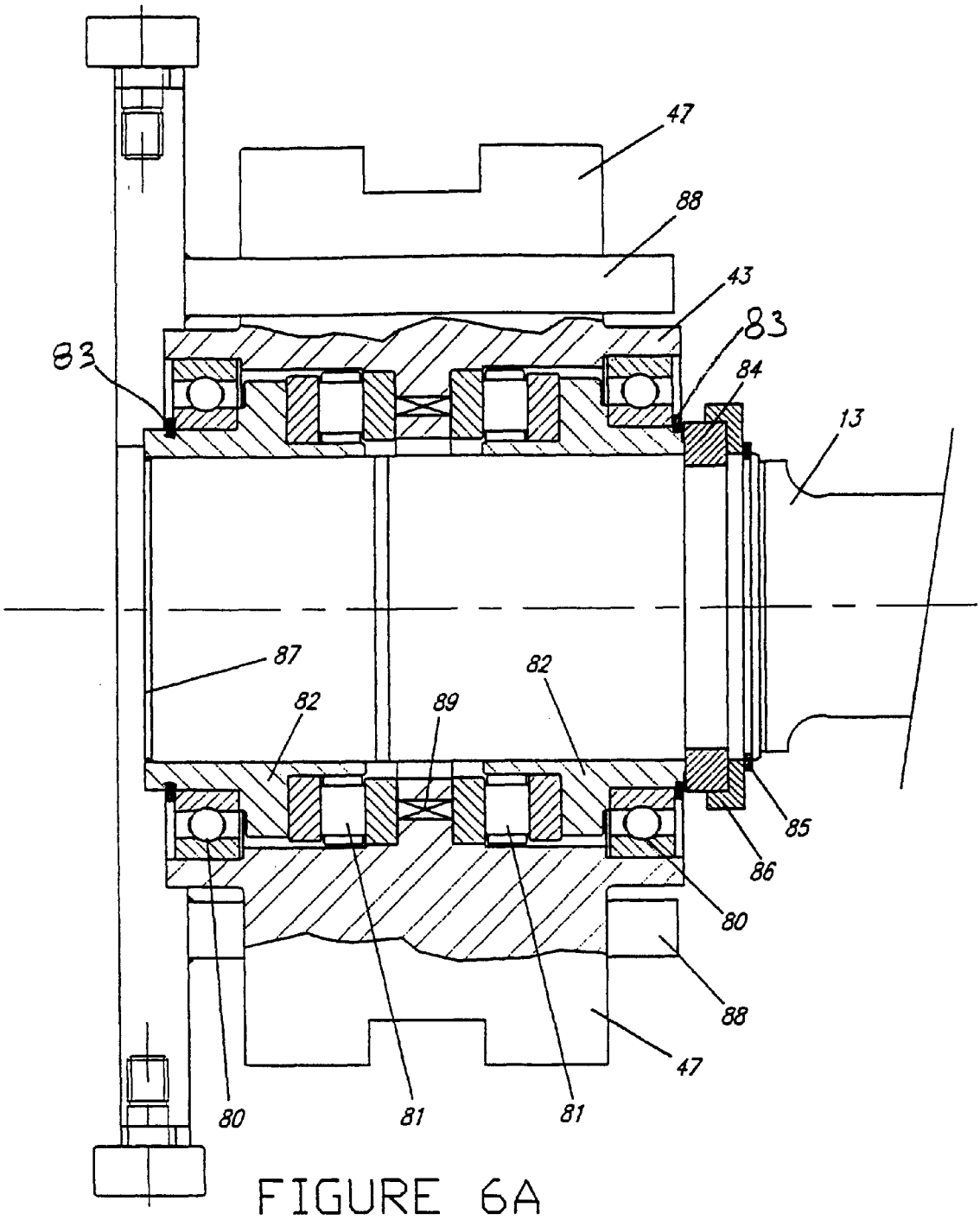
FIG. 6*a* is a fragmentary plan view, partly in cross-section, constituting an enlarged portion of FIG. 6.

The arrangement for axial shifting of each intermediate roll is shown in FIG. 6 and FIG. 6*a*.

First, a thrust housing 43 is mounted on bearings on the rear neck of intermediate roll 13. Thrust bearings 81, used to transmit axial thrust forces, and radial bearings 80, used to maintain concentricity and mounted on sleeves 82 are fitted into each end of the thrust housing, and are retained by snap rings 83. Springs 89 are used to preload thrust bearings 81.

This assembly is then installed by sliding it on to the rear roll neck, up to shoulder 87 and held in place by split ring 84 which fits in a groove on the roll neck and is itself held in place by full ring 86, located by snap ring 85 in the roll neck. The thrust housing is prevented from rotating by fork assembly 88 which engages ears 47 on the thrust housing, and are bolted to chock 16. The same structure is present on lower chock 16*a*.

As shown in FIG. 6, shift frames 68 are bolted on to rear Mae West blocks 35 and incorporate keys 91 upon which shift fingers 46 are guided so they are only free to move in a direction parallel to the roll axes. Each shift finger 46 can be shifted by its respective hydraulic cylinder 45 which is flange mounted to shift frame 68. As each shift finger 46 engages with the recess in mating ear 47 of the thrust housing, operation of hydraulic cylinders 45 will cause axial shifting of intermediate roll 13.

During operation of the mill, both left and right shift cylinders 45 will be connected to a single thrust housing 43. Each cylinder being provided with a position transducer 64, (usually of the "Temposonics" type made by M.T.S. Corp.) only one of the transducers will be used for position feedback, and a closed loop position servo will be used to position the cylinder on which that cylinder is mounted (the master cylinder). At this time the second cylinder (the slave cylinder) will be connected hydraulically in parallel with the master cylinder. This technique ensures that the two cylinders apply equal shift forces to the thrust housing, thus avoiding bending of the roll neck.

At roll change time, when the intermediate rolls are separated so that the thrust housing ears disengage from the shift fingers, the two cylinders are hydraulically isolated (using blocking valves, not shown) and each cylinder is positioned by its own closed loop position servo, using its own transducer 64 for feedback. This technique ensures that both shift fingers can be properly positioned so that, after new roll assemblies are inserted in the mill, and the intermediate rolls moved vertically (by approximately 100 mm) towards each other to the working position, the shift fingers engage smoothly with recesses in cars 47.

Figure 10:
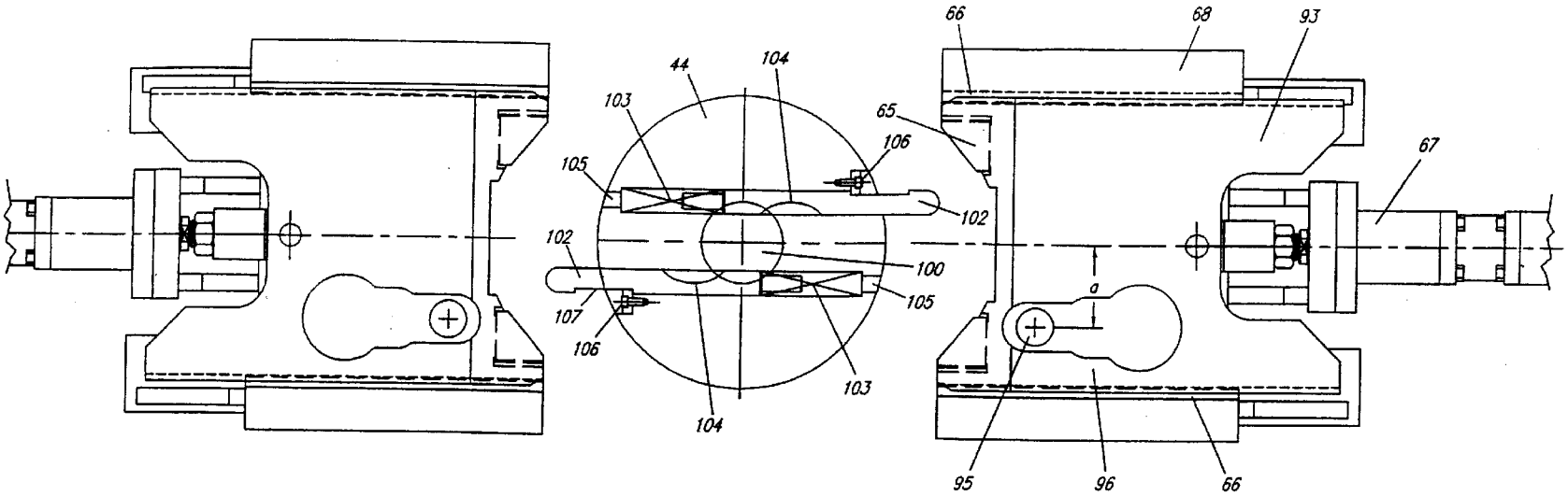
FIG. 10 is a fragmentary cross-sectional view taken along section line 10—10 of FIG. 6 and showing spindle clamps in the open position.

During normal operation of the mill, the weight of the mill drive spindles and their couplings 44 is supported by intermediate rolls 13. When the rolls are withdrawn from the mill at roll change time it is necessary to support the spindles and couplings by separate means. This function is provided by clamp blocks 65 (see FIG. 6 and 10). These blocks are usually curved to match the diameter of coupling 44, but can also be V-shaped as shown in FIG. 10. They are attached to clamp plates 93 which are slideably guided in frame 68 on keys 66, which constrain the plates so they can only move in a horizontal direction normal to the roll axes. Each plate 93 is actuated by spindle clamp cylinder 67 which, when extended, will clamp coupling 44 against the force of opposing cylinder 67 through clamp blocks 65. This not only serves to support the spindle weight, but also ensures that, as the rolls are withdrawn and inserted, the drive coupling 44 will not move away from its axial position.

Slot 96 is provided in clamp plate 93 and piston rod 95 of shift cylinder 45 passes through this slot. Thus the shift cylinder 45 and spindle clamp cylinder 67 can operate independently. It should be noted here that the spindle clamp cylinder 67 and spindle clamp block 65 and plate 93 must be positioned to clamp the spindles when the rolls 13 are set to the removal level (FIG. 4). Whereas the axial shift cylinder 45, piston rod 95 and shift finger 46 must be set to the mean working level (FIG. 5). Thus the slot in clamp plate 93 must be positioned approximately 100 mm away from its center line, and this plate must be very deep (approximately 300 mm) so that it can contain this slot without being unduly weakened by the slot. The structure can be seen, for a typical upper assembly, in FIG. 10, where a=100 mm approximately.

As is well known in the art, the drive couplings can be of various designs, such as spade couplings, gear couplings or universal (Hooke's couplings or Cardan couplings). Whichever type of coupling is adopted it is necessary for each spindle to incorporate splines so that the spindle length can adjust to the various axial positions of the intermediate roll 13 as the shift cylinders 45 are operated.

To ensure that each roll 13 remains fully engaged with coupling hub 44 (see FIG. 6) at all times during rolling, the roll is provided with a small diameter extension 100 which projects into a matching recess in coupling hub 44. This extension is provided with two straight grooves 101 of semi-circular cross section. It is known in the art to provide a transverse hole in coupling 44 which is concentric with one groove 101, and to use a pin mounted in this hole to lock the coupling hub on to the roll. However, such a connection requires manual intervention to remove and install the pin at roll change time. The present invention provides for automatic locking and unlocking of the coupling hub on the roll which occurs during release and engagement of the spindle clamps respectively.

As is shown in FIG. 10, coupling hub 44 is provided with two transverse holes 105, each hole being coaxial with one semi-circular groove 101. Holes 105 are not through holes, but are provided with a reduced diameter portion at one end, thus forming a pocket. A compression spring 103 is inserted into each hole and a plunger 102 is pressed against the spring and is retained by retainer 106 which is bolted to coupling hub 44, and which engages with slot 107 in plunger 102. This not only holds the spring lightly preloaded, but also prevents rotation of the plunger about its axis.

In the position shown, the normal operating position, the spring (aided by centrifugal force) presses the plunger against retainer 106, and the full diameter portion of plunger 102 engages with semi-circular groove 101, thus locking the coupling hub 44 on to roll 13 so that if the roll is axially shifted using shift cylinders 45, the coupling hub 44 will move axially with the roll.

Figure 11:
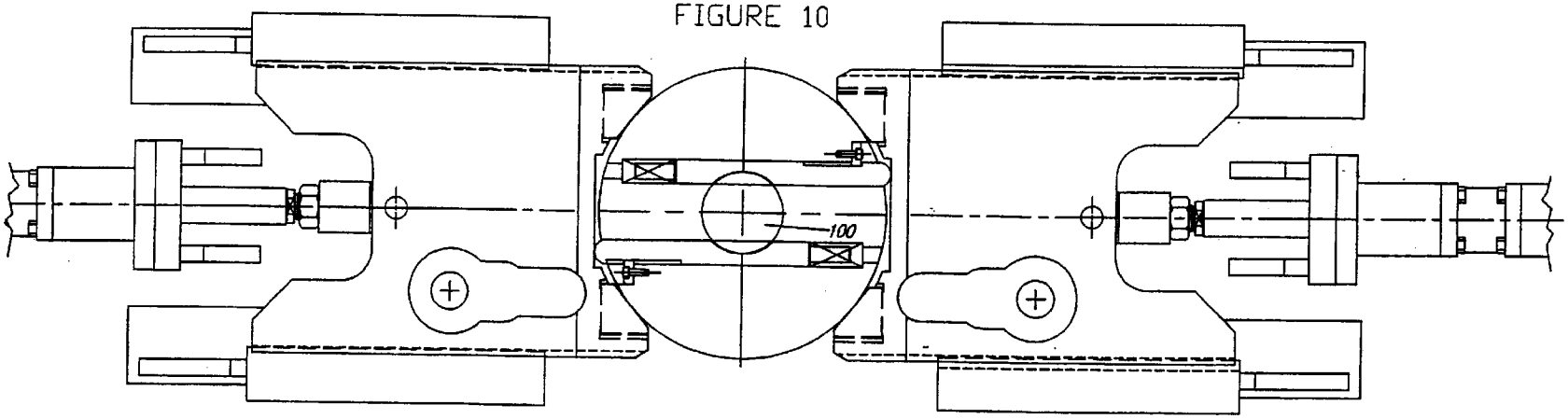
FIG. 11 is a fragmentary cross-sectional view, similar to FIG. 10 and showing spindle clamps in the closed position.

At roll change time, when the spindle clamp cylinders 67 are operated, as shown in FIG. 11, clamp plates 93 depress plungers 102 the required amount at the same time that they clamp coupling hub 44.

Each plunger 102 is provided with a circular scallop 104 such that, when the plunger is depressed into the hole the required amount, the scallop lines up concentric with roll extension 100, as shown in FIG. 11 and the roll is no longer locked into the coupling hub, and can be removed in an axial direction. A new roll can be freely inserted as long as the coupling remains clamped.

After inserting new rolls, and ensuring that they are fully engaged with the coupling hubs, the spindle clamp cylinders 67 can be released, and springs 103 will once again urge plungers 102 towards retainers 106 so that the full diameter portions of the plungers will once again engage grooves 101 in roll extension 100, locking coupling hubs to the rolls.

Modifications can be made in the invention without departing from the spirit of it.

What is claimed:

1. A 6-high cold rolling mill comprising a pass line, free floating work rolls, upper and lower intermediate assemblies, each intermediate roll assembly comprising front and rear chocks, an intermediate roll having neck bearings mounted respectively in said chocks, left and right side support assemblies for one of said work rolls mounted to and extending between said chocks and at least one lubrication passage in fluid communication with at least one of said intermediate roll neck bearings or said side support assemblies, backup rolls, front and rear doors, thrust bearings on said doors comprising axial location elements for said work rolls, vertically acting hydraulic cylinders for intermediate roll bending, balancing, and counterbalancing, for vertical shifting of said intermediate roll assemblies between their working levels and their removal levels, and for support of said upper work roll at roll change time, horizontally acting hydraulic cylinders for axial shifting of said intermediate rolls, means for axially locating at least one of said intermediate roll assemblies when it is at its respective working level, said means allowing axial movement of said at least one intermediate roll assembly when it is at its respective removal level, at least one lubrication connection device configured to connect at least one of said at least one lubrication passage in fluid communication with a source of lubrication when a respective one of said intermediate roll assemblies is at its working level, said at least one lubrication connection device ceasing to connect said at least one lubrication passage in fluid communication with said source of lubrication as a result of said respective intermediate roll assembly vertically shifting away from its working level toward its removal level, said intermediate roll assemblies disengaging from all hydraulic cylinders and from said means for axially locating said intermediate rolls as a result of said vertical shifting of said intermediate roll assemblies away from their working level toward their removal level, whereby said intermediate roll assemblies may be removed from the mill by shifting them axially toward said front side.

2. The mill claimed in claim 1 wherein said upper and lower intermediate rolls are driven by upper and lower intermediate roll drive spindles, said mill including upper and lower spindle clamp assemblies to clamp and support said upper and lower drive spindles during the removal from said mill and the insertion in said mill of said intermediate roll assemblies.

3. The mill claimed in claim 1 wherein said at least one lubrication connection device comprises vertically acting oppositely directed, hollow spring plungers mounted on said front and rear doors, said upper and lower front chocks and said upper and lower rear chocks having respective facing upper and lower surfaces with at least one hole therein connected by a respective one of said at least one lubrication passage to at least one of said neck bearings, when said intermediate roll assemblies are at their working levels each plunger engages and forms a fluid-tight seal with its respective chock hole, said plungers being disconnected from their respective chock holes when said intermediate roll assemblies are at their removal levels.

4. The mill claimed in claim 1 wherein said at least one lubrication connection device comprises vertically acting, oppositely directed, hollow spring plungers mounted on said rear door, said upper and lower rear chocks having respective facing upper and lower surfaces with at least one hole therein connected by a respective one of said at least one lubrication passage to at least one of said side support assemblies, when said intermediate roll assemblies are at their working level, each plunger engages and forms a fluid-tight seal with its respective chock hole, said plungers being disconnected from their respective chock holes when said intermediate roll assemblies are vertically shifted to their removal levels.

5. The mill claimed in claim 1 including front and rear mill housings, a left side front and rear pair of Mae West blocks and a right side front and rear pair of Mae West blocks, each of said Mae West blocks being mounted in a respective one of said housings, a side support beam spanning between the front and rear Mae West blocks of each pair, all of said vertically acting hydraulic cylinders being mounted in or on said Mae West blocks, whereby they need not be removed with said intermediate roll assemblies.

6. The mill claimed in claim 1 including front and rear mill housings, a left side front and rear pair of Mae West blocks and a right side front and rear pair of Mae West blocks, each of said Mae West blocks being mounted in a respective one of said housings, wherein said means for axially locating at least one of said intermediate roll assemblies comprise ears on at least one of said chocks of the respective intermediate roll assembly, each ear engaging a pocket of its respective one of said Mae West blocks when said respective intermediate roll assembly is at said working level, and disengaging from said pocket when said respective intermediate roll assembly is at said removal level.

7. The mill claimed in claim 1 including, for each upper and lower intermediate roll, a driven end, a thrust housing mounted on said driven end, a pair of shift fingers for said thrust housing, a pair of recesses in said thrust housing engageable by said shift fingers, each shift finger being mounted on a rod shiftable axially by one of said horizontally acting cylinders to axially adjust said intermediate roll, said shift fingers disengaging from said thrust housing when said intermediate roll assembly is vertically shifted to its removal level and re-engaging when said intermediate roll assembly is vertically shifted to its working level.

8. The mill claimed in claim 1 wherein said at least one lubrication connection device comprises at least one hollow spring plunger mounted on a respective one of said front door and rear door, at least one of said upper and lower chocks associated with said at least one door having a respective surface with at least one respective hole therein connected by a respective one of said at least one lubrication passage to at least one of said neck bearings, when the associated intermediate roll assembly is at its working level said at least one plunger engages and forms a fluid-tight seal with its respective chock hole, said at least one plunger being disconnected from its respective chock hole when said associated intermediate roll assembly is at its removal level.

9. The mill claimed in claim 1 wherein said at least one lubrication device comprises at least one hollow spring plunger mounted on a respective one of said front door and said rear door, at least one of said upper and lower chocks associated with said at least one door having a respective surface with at least one respective hole therein connected by a respective one of said at least one lubrication passage to at least one of said side support assemblies, when the associated intermediate roll assembly is at its working level said at least one plunger engages and forms a fluid-tight seal with its respective chock hole, said at least one plunger being disconnected from its respective chock hole when said associated intermediate roll assembly is vertically shifted to its removal level.

10. The mill claimed in claim 2 including, for each upper and lower, intermediate roll a driven end, a thrust housing mounted on said driven end, a pair of shift fingers for said thrust housing, a pair of recesses in said thrust housing engageable by said shift fingers, each shift finger being mounted on a rod shiftable axially by one of said horizontally acting cylinders to axially adjust said intermediate roll, said shift fingers disengaging from said thrust housing when said intermediate roll assembly is vertically shifted from its working level to its removal level and re-engaging when said intermediate roll assembly is vertically shifted from its removal level to its working level.

11. The mill claimed in claim 3 wherein said at least one lubrication connection device comprises vertically acting, oppositely directed, hollow spring plungers mounted on said rear door, said upper and lower rear chocks having respective facing upper and lower surfaces with at least one hole therein connected by a respective one of said at least one lubrication passage to at least one of said side support assemblies, when said intermediate roll assemblies are at their working level, each plunger engages and forms a fluid-tight seal with its respective chock hole, said plungers disengaging from their respective chock holes when said intermediate roll assemblies are vertically shifted to their removal levels.

12. The mill claimed in claim 10 wherein said spindle clamp assemblies comprise hydraulically actuated plates on each side of each side of each intermediate roll drive spindle, said rod of each shift finger passing through a slot in the adjacent one of said plates.

13. The mill claimed in claim 11 including front and rear mill housings, a left side front and rear pair of Mae West blocks and a right side front and rear pair of Mae West blocks, each of said Mae West blocks being mounted in a respective one of said housings, a side support beam spanning between the front and rear Mae West blocks of each pair, all of said vertically acting hydraulic cylinders being mounted in or on said Mae West blocks, whereby they need not be removed with said intermediate roll assemblies.

14. The mill claimed in claim 11 including, for each upper and lower intermediate roll, a driven end, a thrust housing mounted on said driven end, a pair of shift fingers for said thrust housing, a pair of recesses in said thrust housing engageable by said shift fingers, each shift finger being mounted on a rod shiftable axially by one of said horizontally acting cylinders to axially adjust said intermediate roll, said shift fingers automatically disengaging from said thrust housing when their associated intermediate roll assembly is vertically shifted from its working level to its removal level and re-engaging when their associated intermediate roll assembly is vertically shifted from its removal level to its working level.

15. The mill claimed in claim 13 wherein said means for axially locating at least one of said intermediate roll assemblies comprise ears on at least two of said intermediate roll chocks, each ear engaging a pocket of its respective Mae West block when said upper and lower intermediate roll assemblies are at said working levels, and disengaging from said pocket when said intermediate roll assemblies are at said removal levels.

16. The mill claimed in claim 15 including, for each upper and lower intermediate roll, a driven end, a thrust housing mounted on said driven end, a pair of shift fingers for said thrust housing, a pair of recesses in said thrust housing engageable by said shift fingers, each shift finger being mounted on a rod shiftable axially by one of said horizontally acting cylinders to axially adjust said intermediate roll, said shift fingers disengaging from said thrust housing when their associated intermediate roll assembly is vertically shifted to its removal level.

17. The mill claimed in claim 8 wherein said at least one lubrication connection device comprises at least one hollow spring plunger mounted on a respective one of said front door and said rear side door, at least one of said upper and lower chocks associated with said at least one door having a respective surface with at least one respective hole therein connected by a respective one of said at least one lubrication passage to at least one of said side support assemblies, when the associated intermediate roll assembly is at its working level said at least one plunger engages and forms a fluid-tight seal with its respective chock hole, said at least one plunger disengaging from its respective chock hole when said associated intermediate roll assembly is vertically shifted to its removal level.

18. A 6-high cold rolling mill comprising free floating work rolls, upper and lower intermediate roll assemblies, each intermediate roll assembly comprising front and rear chocks, an intermediate roll having neck bearings mounted respectively in said chocks, left and right side support assemblies for one of said work rolls mounted to and extending between said chocks and at least one lubrication passage in fluid communication with at least one of said intermediate roll neck bearings or said side support assemblies, backup rolls, front and rear doors, thrust bearings on said doors comprising axial location elements for said work rolls, said intermediate rolls being vertically shiftable between a working level and a removal level, at least one lubrication connection device configured to connect at least one of said at least one lubrication passage in fluid communication with a source of lubrication when a respective one of said intermediate roll assemblies is at its working level, said at least one lubrication connection device ceasing to connect said at least one lubrication passage in fluid communication with said source of lubrication as a result of said respective intermediate roll assembly vertically shifting away from its working level toward its removal level.

19. The mill claimed in claim 18 wherein said at least one lubrication connection device comprises vertically acting oppositely directed, hollow spring plungers mounted on said front and rear doors, said upper and lower front chocks and said upper and lower rear chocks having respective facing upper and lower surfaces with at least one respective hole therein connected by a respective one of said at least one lubrication passage to at least one of said neck bearings, when said intermediate roll assemblies are at their working levels each plunger engages and forms a fluid-tight seal with its respective chock hole, said plungers being disconnected from their respective chock holes when said intermediate roll assemblies are at their removal levels.

20. The mill claimed in claim 18 wherein said at least one lubrication connection device comprises vertically acting, oppositely directed, hollow spring plungers mounted on said rear door, said upper and lower rear chocks having respective facing upper and lower surfaces with at least one respective hole therein connected by a respective one of said at least one lubrication passage to at least one of said side support assemblies, when said intermediate roll assemblies are at their working level, each plunger engages and forms a fluid-tight seal with its respective chock hole, said plungers being disconnected from their respective chock holes when said intermediate roll assemblies are shifted to their removal level.

21. 6-high cold rolling mill comprising upper and lower intermediate rolls vertically shiftable between a working level and a removal level, at least one respective intermediate roll of said upper and lower intermediate rolls having a respective driven end, a respective thrust housing mounted on said respective driven end, at least one shift finger for said respective thrust housing, a complementarily shaped recess in said respective thrust housing engageable by said at least one shift finger, each said at least one shift finger being mounted on a rod shiftable axially by an actuator to axially adjust said respective intermediate roll, said at least one shift finger disengaging from its respective thrust housing when said respective intermediate roll is vertically shifted to its removal level and re-engaging when said intermediate roll is vertically shifted to its working level.

22. A 6-high cold rolling mill comprising free floating work rolls, intermediate rolls, vertically acting hydraulic cylinders for intermediate roll bending, balancing, and counterbalancing, for vertical shifting of said intermediate rolls between their working levels and their removal levels, and for support of said upper work roll at roll change time, front and rear mill housings, a left side front and rear pair of Mae West blocks and a right side front and rear pair of Mae West blocks, each of said Mae West blocks being mounted in a respective one of said housings, a side support beam spanning between the front and rear Mae West blocks of each pair, all of said vertically acting hydraulic cylinders being mounted in or on said Mae West blocks, whereby they need not be removed with said intermediate rolls.

23. The mill claimed in claim 22 comprising ears on at least two intermediate roll chocks, each ear engaging a pocket of its respective one of said Mae West blocks when said intermediate rolls are at said working levels, and disengaging from said pocket when said intermediate rolls are at said removal levels.

* * * * *

UNITED STATES PATENT AND TRADEMARK OFFICE

CERTIFICATE OF CORRECTION

PATENT NO. : 6,041,636
DATED : March 28, 2000
INVENTOR(S) : Alexander Datzuk; Yves Guillot and Lucas M. Young It is certified that error appears in the above-indentified patent and that said Letters Patent is hereby corrected as shown below:

Column 12, line 11, (claim 12), before "intermediate" delete "side of each"

Column 12, line 6, (claim 20), change "level" to - - levels - -

Signed and Sealed this

Fifteenth Day of May, 2001

*Attest:*

Nicholas P. Godici

NICHOLAS P. GODICI

*Attesting Officer*

*Acting Director of the United States Patent and Trademark Office*